US005831380A

United States Patent [19]

Van Zutphen et al.

[11] Patent Number: 5,831,380

[45] Date of Patent: Nov. 3, 1998

[54] ELECTRON-OPTICAL DEVICE

[75] Inventors: Tom Van Zutphen; Frederik C. Gehring, both of Eindhoven, Netherlands

[73] Assignee: U.S. Philips Corporation, New York, N.Y.

[21] Appl. No.: 709,405

[22] Filed: Sep. 4, 1996

[30] Foreign Application Priority Data

Sep. 4, 1995 [EP] European Pat. Off. ..... 95202373

[51] Int. Cl.[6] ..... H01J 29/20; H01J 29/70

[52] U.S. Cl. ..... 313/422; 313/439; 313/447; 313/427

[58] Field of Search ..... 313/422, 444, 313/439, 438, 446, 447, 456, 458, 460, 434, 427

[56] References Cited

U.S. PATENT DOCUMENTS

| | | | |
|---|---|---|---|
| 2,604,599 | 7/1952 | Breeden | 313/83 |
| 4,574,216 | 3/1986 | Hoeberechts et al. | 313/444 |
| 4,749,904 | 6/1988 | Vasterink | 313/424 |
| 5,144,197 | 9/1992 | Peters et al. | 313/422 |
| 5,202,609 | 4/1993 | Tomii et al. | 313/422 X |
| 5,220,240 | 6/1993 | Ohoshi et al. | 313/422 |
| 5,497,046 | 3/1996 | Van Gorkom et al. | 313/422 |

FOREIGN PATENT DOCUMENTS

| | | | |
|---|---|---|---|
| 0660358A1 | 6/1995 | European Pat. Off. | H01J 1/30 |

*Primary Examiner*—Ashok Patel
*Attorney, Agent, or Firm*—Robert J. Kraus

[57] ABSTRACT

An electron has an electron-emitting region, a longitudinal axis and an arrangement of apertured electron grids along the axis. A first grid has an aperture for passing electrons, which aperture is located further outwards with respect to the longitudinal axis than the emitting region. One of the other grids is provided with a shield so as to shield the edge wall of the aperture, if it is located within direct view of the electron-emitting region, from incidence of positive ions.

11 Claims, 5 Drawing Sheets

ELECTRON-OPTICAL DEVICE

BACKGROUND OF THE INVENTION

The invention relates to an electron-optical device having a longitudinal axis, an electron-emitting region located in a first plane transverse to the axis, and an electron target located opposite thereto in a second plane transverse to the axis, and, further, comprising a grid arrangement including at least one electron grid arranged along the longitudinal axis proximate to the electron emitting region and having at least one aperture for passing electrons.

Such an electron-optical device may form the cathode and (part of) the electron gun in a cathode ray tube, the electron target being the phosphor screen.

A device of this type is known from U.S. Pat. No. 4,749,904 and U.S. Pat. No. 4,574,216.

The known device has an electron emitter of the semiconductor type (referred to as cold cathode) which is very sensitive to bombardment with (highly) energetic particles. Since residual gases always remain in the evacuated envelope of an electron-optical device, despite pumping and gettering, the electron current releases negative and positive ions from these residual gases. The negative ions are accelerated towards the target. Under the influence of accelerating and focusing fields generated in the tube by means of voltages on the electron grids, a part of the positive ions moves towards the emitter.

The electron-emitting region may be protected from directly incident particles (positive ions) in the manner as described in the prior art by providing an ion trap plate in the aperture of the third grid of the prior-art triode arrangement.

However, in practice, the lifetime of an emitter protected in such a way does not appear to come up to expectations.

SUMMARY OF THE INVENTION

It is an object of the invention to render the protection against ion incidence more effective.

To this end, the electron-optical device according to the invention is characterized in that, with respect to the longitudinal axis, the aperture in the grid is located further outwards than the emitting region.

In a specific embodiment of such a (diode) configuration, the planar electron-optical system is arranged in a plane which is very close and parallel to the plane of the emitting region. When the correct voltages are applied, the emitted electrons are deflected by means thereof across the first part of their path away from the longitudinal axis. Then they pass the aperture in the first grid which is further remote from the longitudinal axis ("further outwards") than the emitting region. Returning positive ions cannot follow this path and thus cannot land on the emitting region. It is the recognition of the inventor that hereby the emitter lifetime is increased.

The emitting region may produce a single beam. However, a further, very effective embodiment is characterized in that the electron-emitting region has two sub-regions provided with a planar electron-optical system and located symmetrically with respect to the longitudinal axis, an aperture in the first grid located further outwards ("off-axis") with respect to the longitudinal axis being associated with each sub-region.

However, it appears that, even when using these measures, there is some degradation of the emitter in use, so that its lifetime, and hence that of the device as a whole, is limited.

The invention is based on the further recognition that the presence of one or more grids with (critical) aperture edges in direct view of the electron-emitting region in the electron-optical system is an important reason of degradation of the emitter. When these aperture edges are exposed to particle bombardment, they may scatter particles which reach and damage the electron-emitting region.

The invention therefore provides means to prevent that aperture edges of electron grids located within direct view of the electron-emitting region can scatter particles towards the electron-emitting region.

A first measure of realizing this is to give the apertures in question a knife edge. This means that the wall of an aperture edge has at least one face which extends at an acute angle to a major surface of the grid. Consequently, the spatial aperture angle of the aperture edge with respect to the emitting region is minimized. A second measure is to shield critical aperture edges from particle bombardment by means of one or more shields or (ion) traps which are located downstream with respect to the aperture edge(s), i.e. further remote from the emitting area than the aperture edge (5). Such a shield can be a suitably dimensioned and arranged metal plate or electron grid.

This way of shielding critical aperture edges is very effective and suppresses bombardment of the electron-emitting region with scattered particles to a great extent.

The invention is important for all electron emitters which are sensitive to a bombardment with (highly) energetic particles, thus not only for (avalanche) cold cathodes, in which a PN junction is driven in the reverse direction, but also for, inter alia, P-N type emitters in general (including NEA cathodes, for example, those of the type in which a PN junction is driven in the reverse direction, but also those of the type in which a PN junction is driven in the forward direction), field emitters, surface conduction-type emitters. An important application of this type of cathode is not only in display tubes but also in, for example electron microscopes and electron beam analysis apparatus.

These and other aspects of the invention will be apparent from and elucidated with reference to the embodiments described hereinafter.

DESCRIPTION OF THE PREFERRED EMBODIMENTS

Figure 1:
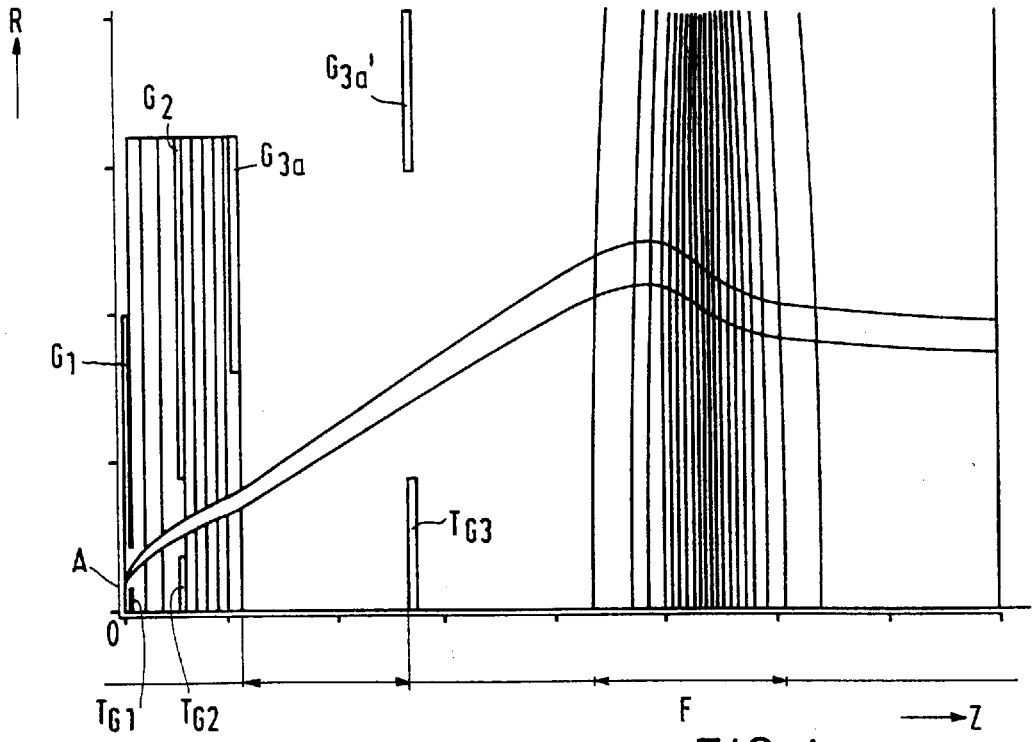
FIG. 1 is a diagrammatic cross-section of a part of an electron-optical device which forms part of a vacuum tube (not shown) having an electron target, with electrical field lines and two electron paths shown therein.

FIG. 1 is a cross-section of a part of an electron-optical device. It has a longitudinal axis Z along which a plurality of electron grids $G_1$, $G_2$ and $G_{3a}$, $G_{3a}$ are arranged. An electron-emitting region A is present proximate to the point 0 of the longitudinal axis. In this case, this is a surface of a semiconductor cathode provided with a planar optical system. If the correct voltages with respect to the electron-emitting region are applied to the planar optical system and to the grids $G_1$, $G_2$, $G_3$, $G_{3a}$, $G'_{3a}$ emitted electrons will follow predetermined electron paths, two of which are shown diagrammatically in FIG. 1. In this embodiment, these paths initially move away from the longitudinal axis Z and then bend back somewhat. The electron-emitting region may be a segment and produce a "solid" beam. The emitting region and the electron grids may be considered to be rotated about the longitudinal axis Z in an alternative embodiment. For example, an annular emitting region in combination with annular electron grids produces a hollow electron beam. This beam can be focused and deflected across an electron target such as, for example a phosphor screen.

The provision of electron traps required within the scope of the invention is complicated in that case. In this respect, it is advantageous to implement the electron-optical device in such a way that it generates (two symmetrical) sub-beams at both sides of the longitudinal axis, which sub-beams first diverge and subsequently converge. Then, as it were, an incomplete, hollow electron beam is produced. The advantage of a hollow beam is a sharper spot on the electron target due to a reduced repelling of spatial charge in the prefocusing and a reduced contribution to the spherical aberration of the focusing lens.

If energetic particles (positive ions) are generated in (the gun section of) the vacuum tube due to collision of electrons, or in another way (photons), these can be accelerated towards the electron-emitting region.

Figure 2:
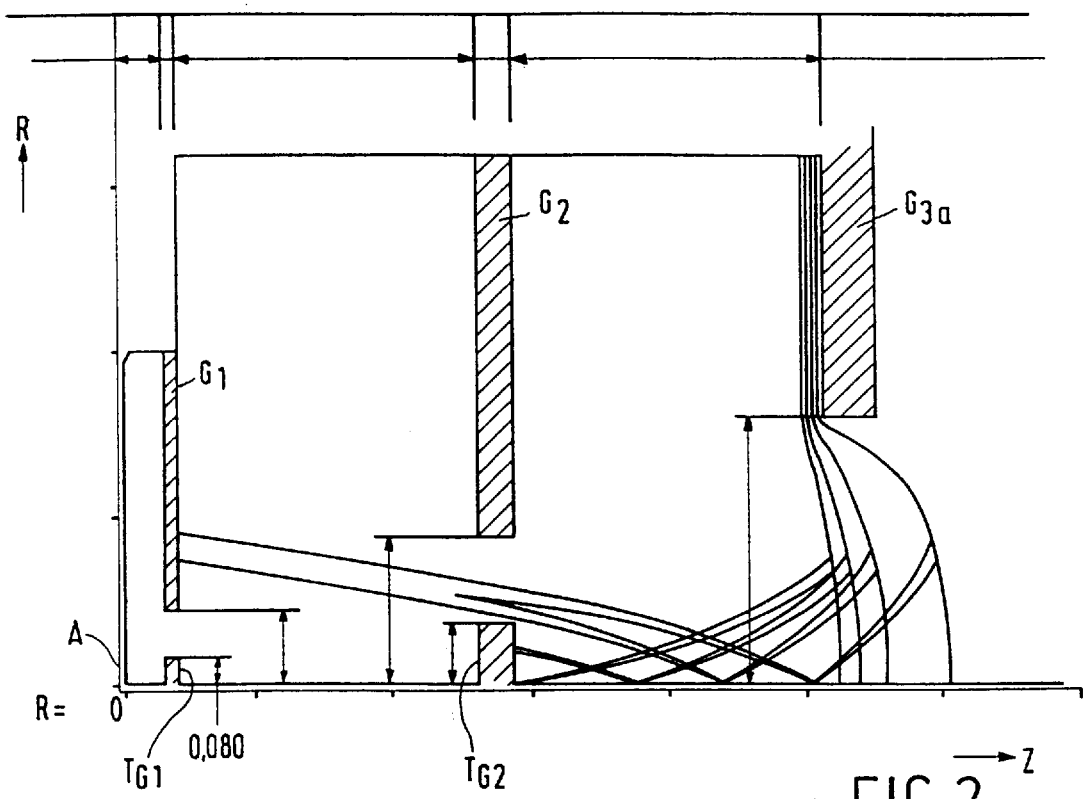
FIG. 2 shows a detail of FIG. 1, showing paths of potentially lifetime-limiting ions originating from prefocusing.

For the purpose of illustration, FIG. 2 diagrammatically shows a detail of the construction of FIG. 1 proximate to the electron-emitting region A. FIG. 2 shows ion paths. The electron-emitting region A is protected from direct incidence by an ion trap in the form of a shield or trap $T_{G1}$ arranged on or proximate to the longitudinal axis Z. Further downstream, an ion trap in the form of a shield or trap $T_{G2}$ is arranged on the axis Z. It ensures that the edge of $G_1$ located within view of the electron-emitting region cannot be impinged by the ions. A shield thus functions as a trap if an imaginary line of connection intersects the shield from a point on the longitudinal axis which is further remote from the emitter to the aperture edge of a grid closer to the emitter. This point is located, for example, in a region F (FIG. 1) in which there is a focusing action (field strength change of lens field).

Figure 3:
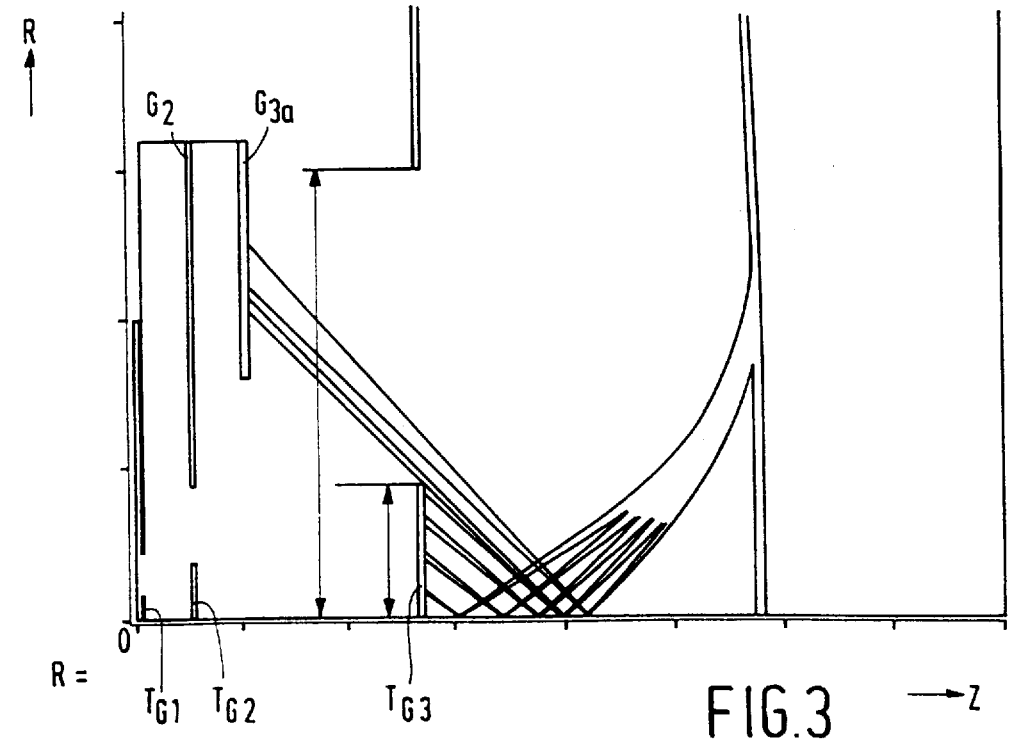
FIG. 3 is a cross-section similar to that in FIG. 1, but now showing paths of potentially lifetime-limiting ions originating from the main lens.

FIG. 3 shows the construction of FIG. 1, now showing ion paths. To ensure that the edges of $G_2$ and $G_{3a}$ within view of the electron-emitting region are not impinged, an electron trap in the form of a plate-shaped electrode, or shield $TG_3$ is arranged on or proximate to the axis Z.

In addition to electron-optical devices with semiconductor cathodes (cold cathodes), the inventive idea is very well applicable to electron-optical devices with other types of emitters which are sensitive to particle bombardment.

Figure 4:
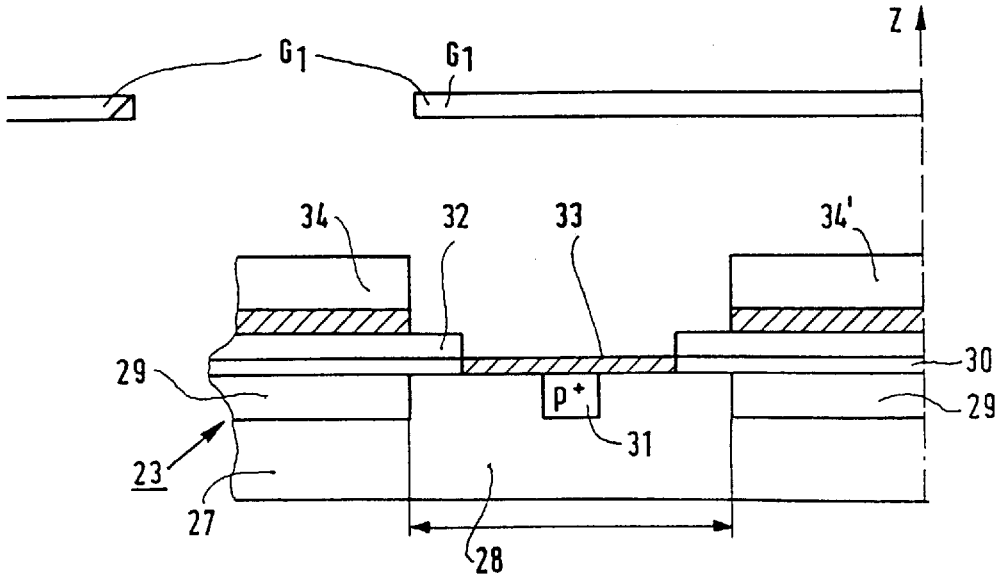
FIG. 4 is a diagrammatic cross-section through a semiconductor cathode having an electron-emitting region.

FIG. 4 is a diagrammatic cross-section of a part of a semiconductor cathode 23, for example an avalanche cold cathode, provided with a planar electron-optical system and a superposed $G_1$ electrode.

In this embodiment, electrons are generated in accordance with a desired pattern in the semiconductor cathode 23. To this end, the cathode 23 comprises a semiconductor body 27 having a p-type substrate 28 of silicon in which an n-type region 29, 30 is provided which consists of a deep diffusion zone 29 and a thin n-type layer 30 at the area of the actual emission region. To reduce the breakdown of the pn junction between the p-type substrate 28 and the n-type region 29, 30 in this region, the acceptor concentration in the substrate is locally increased by means of a p-type region 31 provided by ion implantation. Electron emission is therefore effected within the zone 33 which is not covered by an insulating layer 32 and where, moreover, the electron-emitting surface may be provided with a mono-atomic layer of material decreasing the work function, such as cesium. An electrode system 34, 34' ("planar optical system") is arranged on the insulating layer 32 of, for example, silicon oxide so as to deflect the emitted electrons from the longitudinal axis; this electrode system is also used to shield the subjacent semiconductor body from a direct incidence of positive ions.

Figure 5:
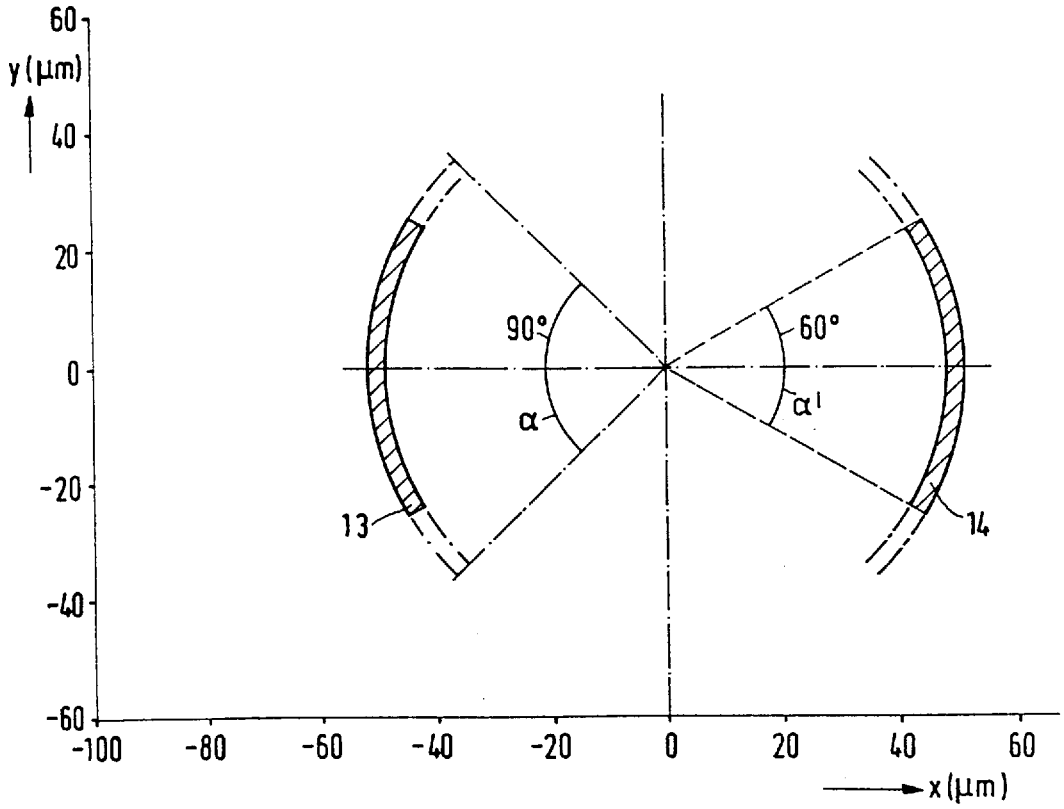
FIG. 5 shows diagrammatically an emitting region divided into two annular segments.

FIG. 5 is a plan view of an emitter construction, in which two circular segment-shaped regions 13, 14 are used for forming two sub-beams. The aperture angle of a circular segment may have a value of between 1° and 160°. In this embodiment, segments 13 and 14 have a (practical) value of the aperture angle $\alpha$ of approximately 60°.

Figure 6:
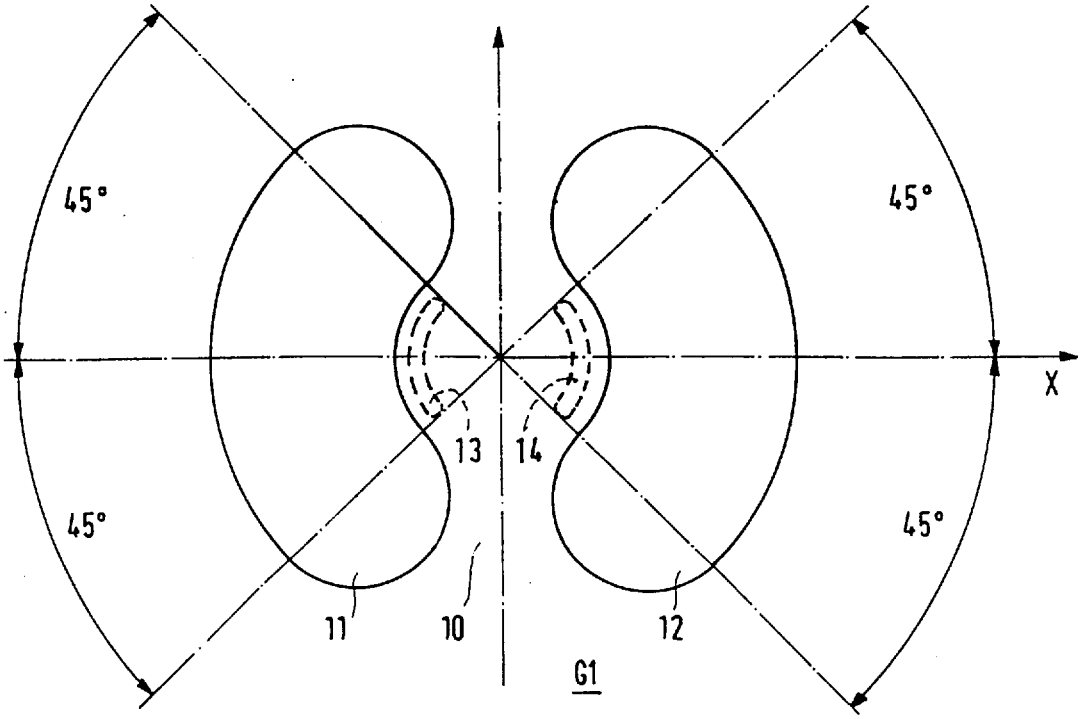
FIG. 6 is a diagrammatic plan view of a G1 electron grid having two apertures, showing below this grid an emitting region divided into two segments (shown in broken lines)

A $G_1$ grid suitable for such a construction is shown in FIG. 6. This Figure shows a grid with a central section 10 shielding the emitting regions 13, 14 from direct ion incidence and having two (kidney-shaped) apertures 11 and 12. The two initially diverging sub-beams formed thereby can be converged on the target. The beam shape per sub-beam in the gun corresponds to that shown in FIG. 1.

Potential (resolution) advantages are:

- smaller spot sizes due to the high cathode brightness (CMT!)
- a smaller spherical aberration contribution of the main lens due to the hollow beam (differential aberration)
- a smaller spatial charge repellency in the prefocusing by using a virtual crossover.

Figure 7:
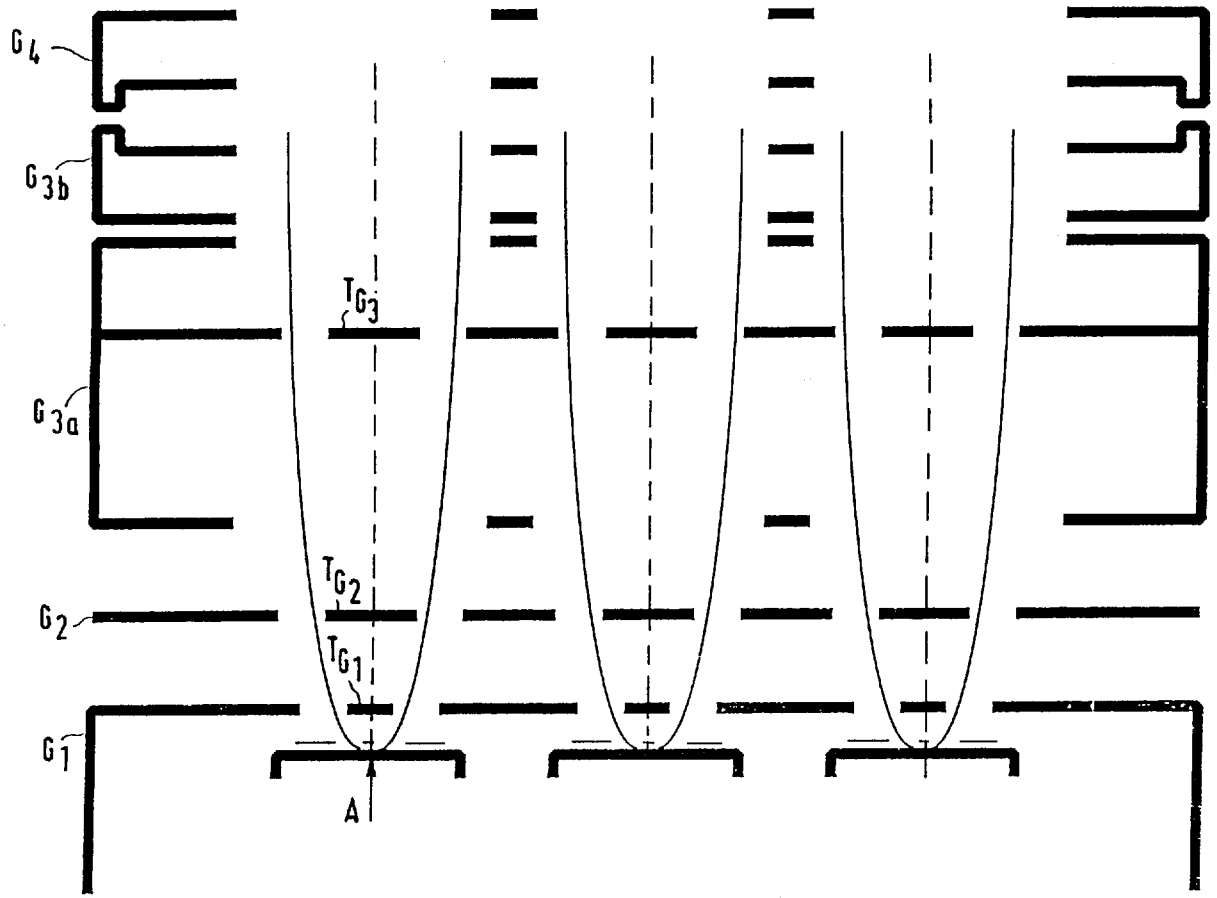
FIG. 7 shows an electron grid arrangement for an electron-optical device according to the invention, having three emitters (R, G, B)

For use in a color display tube (for example, a 21" color monitor tube), for example, a joint $G_1$ grid plate may be taken which is provided with the required number of apertures and by securing to it three separate electron emitters (of the cold cathode type) in a carefully aligned manner, see FIG. 7.

Generally, the invention thus relates to a $G_1$ electron grid provided with an aperture for passing electrons, which grid is arranged to shield the surface of an electron-emitting region from the incidence of particles (such as positive ions). If the (outer) edge of the aperture has a spatial aperture angle (that is to say, if it is within direct view of the electron-emitting region) and if energetic particles can land on it, then an ion trap is required downstream to protect this edge. If this further ion trap and/or further grids themselves also have edges on which particles can land which may reach the electron-emitting region directly or indirectly after scattering, then this edge is to be protected by another ion trap arranged further downstream.

To prevent an edge of an aperture from scattering particles towards the emitting region (or to another edge), it may be efficient to give the aperture a knife edge.

Figure 8:
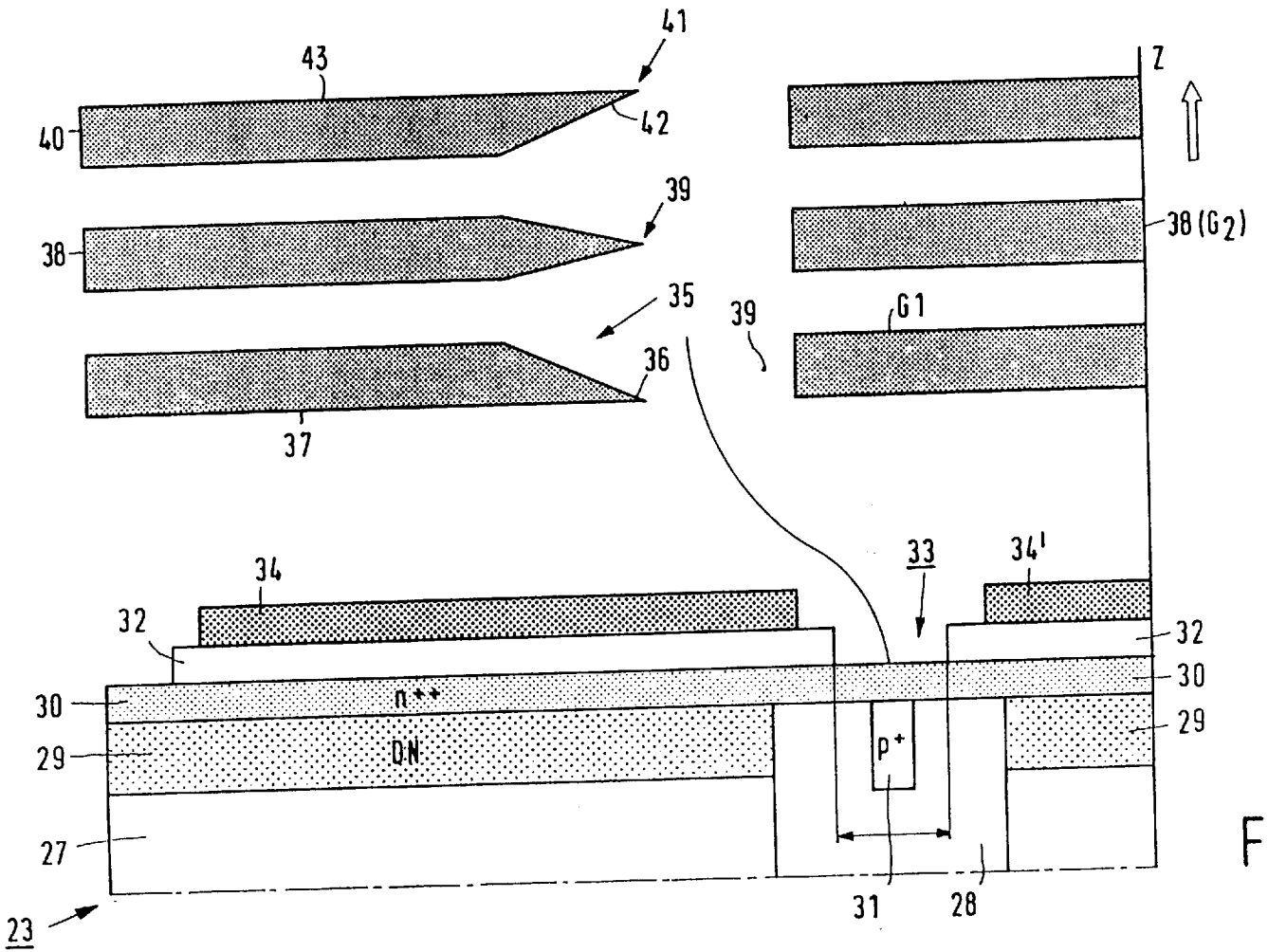
FIG. 8 shows grid apertures having knife edges.

In FIG. 8 different embodiments of apertures having a knife edge are shown. Like FIG. 4, FIG. 8 shows a (semiconductor) cathode 23 provided with a planar electron-optical system and a superposed $G_1$ electrode. Cathode 23 comprises a semiconductor body 27 in which a n-type region 29, 30 is provided which comprises a deep diffusion zone 29 and a thin n-type layer 30 at the area of the actual emission region. Region 28 of the substrate is p-type and the acceptor concentration is locally increased in region 31 by means of ion implantation. Electron emission can therefore be effected within zone 33, which is defined by an insulating layer 32. A planar optical system with electrodes 34, 34' is used for deflecting emitted electrons. The superposed $G_1$ electrode has an aperture with a knife edge (tapered edge) at a position where a conventional (perpendicular) edge might scatter incoming particles towards the emitting region 33. In this example face 36 of knife edge 35 makes an acute angle with the emitting region 33 facing surface 37 of grid $G_1$.

A particle (ion) trap 38 in the form of an apertured plate may be provided to protect the edges of the aperture 39 in grid $G_1$ against incoming particles. On a specific embodiment grid $G_2$ may itself be used as (ion) trap and may be provided with a knife edge 39 (in this example having faces which make acute angles with each of the major surfaces of trap 38).

By reference numeral 40 a still further trap, or grid, is indicated, which in this example has a knife edge face 42 which makes an acute angle with the major surface 43 which is remote from the electron emitting region 33.

The use of a knife edge may advantageously be combined with the use of an ion trap.

An ion trap and an electron-optical grid may be combined, as in the case of $G_1$ and $G_2$ (see FIG. 7) or an ion trap may be arranged separately (particularly in an equipotential space), as in the case of $T_{G3}$ (see FIG. 7).

Summarizing, the invention relates to an electron-optical device having an electron-emitting region, a longitudinal axis and an arrangement of apertured electron grids along the axis.

The first grid has an aperture for passing electrons, which aperture is located further outwards with respect to the longitudinal axis than the emitting region. One of the further grids is provided with a shield so as to shield the edge wall of the aperture, if it is located within direct view of the electron-emitting region, from incidence of positive ions.

We claim:

1. An electron-optical device for producing an electron beam directed generally along an axis, said device comprising:

a. an electron emitter disposed on the axis and including an electron-emitting region oriented for emitting the electron beam generally in the direction of the axis;

b. a deflection-electrode structure disposed adjacent the electron-emitting region for deflecting the electron beam away from the axis;

c. an arrangement of grid electrodes disposed along the axis and including respective apertures for passing the electron beam, said arrangement being operable to redirect said electron beam along the general direction of the axis, the aperture in at least one of said grid electrodes being disposed further from the axis than the electron-emitting region, thereby preventing charged particles traveling parallel to the axis and toward the electron-emitting region from passing through said aperture and striking said region.

2. A device as in claim 1 where the electron-emitting region is disposed on the axis.

3. A device as in claim 1 where the electron emitter and the deflection-electrode structure form parts of a planar electron-optical system.

4. A device as in claim 1 where said electron beam includes first and second separate parts, each directed generally along the axis, and where:

a. the electron emitter includes first and second parts of the electron-emitting region for emitting the first and second electron-beam parts, respectively, generally in the direction of the axis;

b. the deflection-electrode structure is arranged for deflecting both of the first and second electron-beam parts away from the axis; and c. the grid electrodes each include first and second apertures for passing the respective first and second electron-beam parts, the first and second apertures in at least one of said grid electrodes being disposed further from the axis than the respective first and second parts of the electron-emitting region.

5. A device as in claim 1 including means for preventing an edge of at least one of said apertures from scattering impinging charged particles toward the electron-emitting region.

6. A device as in claim 5 where said means for preventing an edge from scattering charged particles comprises a surface of said edge which forms an acute angle with respect to an emission surface of the electron-emitting region.

7. A device as in claim 5 where said means for preventing an edge from scattering charged particles comprises adjacent surfaces of said edge which form a knife edge.

8. A device as in claim 1 where at least one of said electron-passing apertures has an edge within direct view of the electron-emitting region, said device including a shield, disposed further from said electron-emitting region than said edge for shielding said edge from charged-particle bombardment.

9. A device as in claim 8 where the shield comprises a portion of one of the grid electrodes.

10. A device as in claim 9 where said grid-electrode portion is disposed proximate the axis.

11. A device as in claim 1 where the arrangement of grid electrodes includes a first grid electrode disposed at a first distance from the electron emitter and a second grid electrode disposed at a further distance from said electron emitter, the electron-beam passing aperture in the second grid electrode being further from the axis than the electron-beam passing aperture in the first grid electrode.

* * * * *